United States Patent [19]

Stenudd

[11] 4,172,671

[45] Oct. 30, 1979

[54] HIGH SPEED PRINTER HAVING A PNEUMATICALLY ACTUATED PRINTING HEAD

[75] Inventor: Sven G. V. Stenudd, Lidingo, Sweden

[73] Assignee: Facit Aktiebolag, Atvidaberg, Sweden

[21] Appl. No.: 856,785

[22] Filed: Dec. 2, 1977

[51] Int. Cl.[2] ..... B41J 23/26; B41J 3/10

[52] U.S. Cl. ..... 400/56; 400/57; 400/59; 400/124; 400/182

[58] Field of Search ..... 101/93.03, 93.05, 93.10; 400/124, 56, 57, 59, 176, 182, 183

[56] References Cited

U.S. PATENT DOCUMENTS

| | | | |
|---|---|---|---|
| 2,979,255 | 4/1961 | Hubl | 235/60.47 |
| 3,750,792 | 8/1973 | Liles | 400/124 |
| 4,010,834 | 3/1977 | Linder | 400/56 |
| 4,027,762 | 6/1977 | Nakauchi | 400/176 X |

*Primary Examiner*—Paul T. Sewell

*Attorney, Agent, or Firm*—Alfred E. Miller

[57] ABSTRACT

A high speed printing device having a printing head provided with printing needles. The printing device is mounted on a movable carriage which is adapted to move adjacent to a recording medium. The printing head is pneumatically operated and also is movable relative to the carriage so that the distance between the printing needles and the recording medium is variable.

6 Claims, 1 Drawing Figure

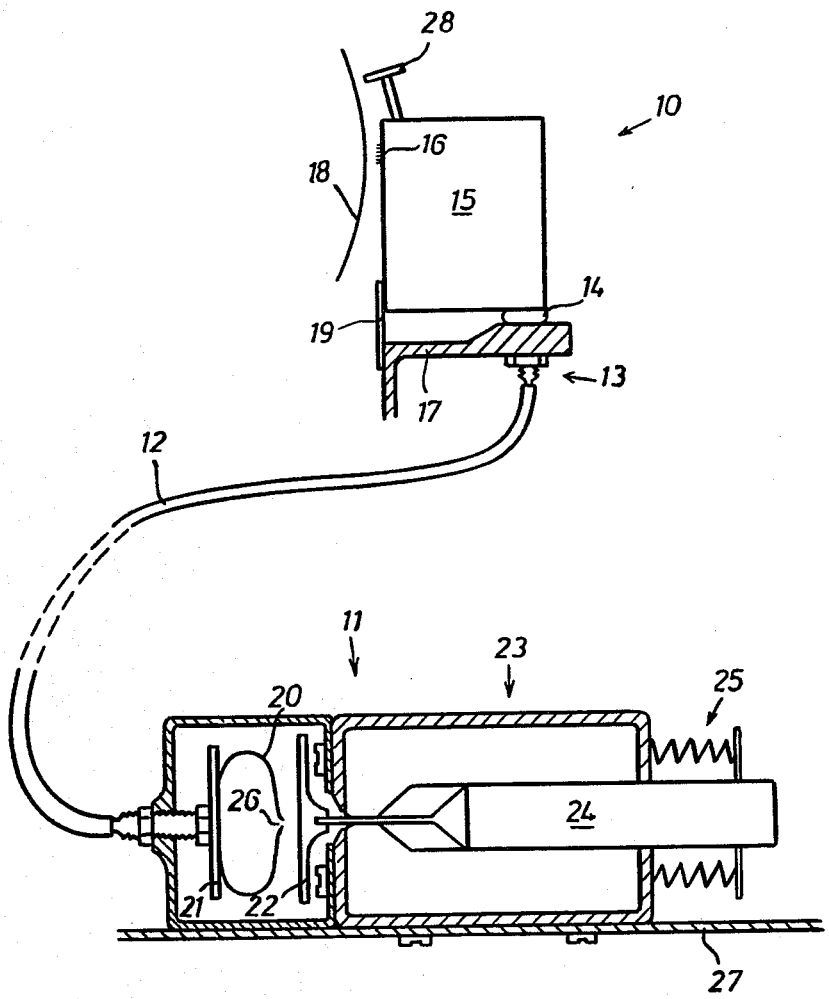
28
10
16
18
15
14
19
13
17
12
11
23
25
20
26
24
21
22
27

HIGH SPEED PRINTER HAVING A PNEUMATICALLY ACTUATED PRINTING HEAD

BACKGROUND OF THE INVENTION

A high speed printer of the type having a printing head movable in a direction perpendicular to the recording medium is known and is used, among other things, to permit different thickness of the recording medium. Usually, one or more than one spring is used to press the printing head into engagement against the recording medium. The drawback of this arrangement is that the printing head is continuously influenced by a force directing the head towards the recording medium, which, among other things, makes changing and feeding of recording paper more difficult. To overcome the above drawbacks it is also known to produce the pressing force by means of an electromagnet mounted on a carriage. In this arrangement, the deenergizing of the magnet results in the printing head being withdrawn from the recording medium. However, locating the electromagnet on the movable carriage, leads to two other drawbacks, i.e., the increased need of space and of serious import, the increase in weight of the movable mass thereby resulting in slower carriage movements, and consequently lower printing speed.

A feature of the present invention is to make it possible to control the printing head in a direction to or from the recording medium and at the same time to eliminate the drawbacks of the above-described known constructions. According to the teachings of the invention a construction has been developed whereby the printing motion relative to the carriage is determined by an expandable bladder or bellows acting upon the printing head, and said bladder or bellows being connected to a second bladder or bellows by means of an air hose. The second bladder or bellows is arranged in a fixed manner relative to the printer frame and has its compression determined by an electromagnet.

In the following description, the invention is explained in greater detail by way of example and with reference to the drawing, which in the sole figure shows diagrammatically a side view of a printing head and a control device for controlling the swinging motion of the printing head.

DESCRIPTION OF THE PREFERRED EMBODIMENT

The device shown in the FIGURE can be divided into three parts, i.e. a printing head part 10, a control part 11 and an air hose 12 connecting these two parts. In this connection it should be mentioned that the control part 11 for the sake of clarity is shown on a larger scale than the remainder of the FIGURE.

In addition to a hose connection 13, which is shown only diagrammatically, the part 10 includes a hollow, elongated bladder or bellows 14, for instance of rubber, which is arranged to act upon the rear of a printing head 15. The printing needles of the head are indicated diagrammatically at 16, the carriage 17 carries the printing head relative to the recording medium at 18. During printing of each separate line, the carriage is so mounted and arranged to move along the recording medium 18, i.e. perpendicular to the plane of the drawing. The printing head is furthermore pivotably secured to the carriage, for instance by means of leaf springs, one of which is shown at 19.

An air hose 12 connects the interior of the bladder 14 to a bladder 20 arranged in the control part 11. The bladder 20 is secured to a disc 21 and is adapted to be pressed together between this disc and a movable disc 22, which is connected to the armature 24 of an electromagnet 23. When the electromagnet is at rest, a spring means, which is diagrammatically shown at 25, holds the armature 24, and thus the disc 22 is located in a back position. The bladder 20 has an opening 26, through which the air within the elements 14, 12, 20 communicates with the surrounding air. The reason for designing the pneumatic system open in this way is that this eliminates the dependency of ambient temperature and atmospheric pressure inherent in closed systems.

Unlike the movable printing head part 10, the control part 11 is immovable and secured to the printer frame 27. This stationary structure is made possible by means of the flexible hose 12.

When the electromagnet 23 is energized, the magnetic forces resulting from said energization pull the armature inwards, i.e. to the left in the FIGURE. This results in the disc 22 closing the opening 26, followed by compression of the bladder 20. The increased pressure within the bladder 20 is propagated through the hose 12 to the bladder 14, causing it to expand. This expansion of bladder 14 forces the printing head 15 to pivot about its hinges 19, causing the printing head part being provided with the printing needles 16 to approach the recording medium 18. A sensing means 28, for example a roller 28, is mounted on the printing head 15 and is arranged to contact the recording medium 18 when the head moves forward, thus limiting the movement of the head toward the recording medium. The volumes of the bladders 14, 20 and the possible armature motion are dimensioned in such a way that the compression of the bladder 20 continues also after the sensing means 28 has stopped the movement of the printing head 15 toward the recording medium. This results in a further increase of the pressure within the system, holding the printing head in a steady forward position. The excess force also has an object to counteract the total reaction force created during the printing operation and tending to remove the printing head from the recording medium.

When the electromagnet 23 is deenergized, the printing head 15 will, due to its resilient attachment to the carriage 17, press air out of the bellows 14, thus causing an expansion of the bladder 20 and, as a result of this, a retraction of the armature 24. In order to guarantee this retraction to be long enough to uncover (expose) the opening 26, there is moreover said spring means 25.

The present high speed printer, that is pneumatically operated results in reduced space requirements and a structure in which the printing head is not continuously influenced by a force directing the head toward the recording medium.

What is claimed is:

1. In a high speed printer having a printing head provided with a plurality of printing needles, a movable carriage, means mounting said printing head on said carriage, said carriage being arranged to move adjacent to and along an axis parallel to the axis of a recording medium, said printing head also being movable relative to recording medium whereby the distance between said printing head and recording medium is variable, the improvement comprising means including an expandable bladder for changing the distance between said printing head and said recording medium, an air supply for said bladder means, means for compressing said bladder means, and an electromagnet which when operative controls said compression means to determine the compression of said bladder means.

2. A high speed printer as claimed in claim 1 wherein said bladder means constitutes a first expandable bladder acting upon said printing head, a second expandable bladder, an air hose connecting said first and second bladder, and a printer frame having said second bladder fixed thereon.

3. A high speed printer as claimed in claim 2 wherein said compression means includes a disc secured to the armature of said electromagnet, said disc being positioned and arranged to press said second bladder.

4. A high speed printer as claimed in claim 3 wherein said second bladder is provided with an opening communicating with the atmosphere, said opening being closed when said disc compresses said second bladder.

5. A high speed printer as claimed in claim 2 wherein means is provided for pivoting said printing head on said carriage, said first bladder is arranged between said carriage and printing head whereby upon expansion thereof causes said printing head to pivotally move toward said recording medium.

6. A high speed printer as claimed in claim 5 further comprising a sensing means mounted on said printing head, said sensing means coacts with said recording medium to stop the movement of said printing head toward said recording medium when a predetermined distance remains between said medium and said printing needles.

* * * * *